United States Patent [19]

Kusche

[11] 4,408,579

[45] Oct. 11, 1983

[54] INDUCTION SYSTEM FOR A TWO-CYCLE ENGINE

[75] Inventor: David W. Kusche, Oshkosh, Wis.

[73] Assignee: Brunswick Corporation, Skokie, Ill.

[21] Appl. No.: 335,017

[22] Filed: Dec. 28, 1981

[51] Int. Cl.[3] ..... F02B 33/04

[52] U.S. Cl. ..... 123/73 V

[58] Field of Search ..... 123/73 V, 73 A, 73 R

[56] References Cited

U.S. PATENT DOCUMENTS

| | | | |
|---|---|---|---|
| 2,612,882 | 10/1952 | Kiekhaefer | 123/73 V |
| 2,669,979 | 2/1954 | Kiekhaefer | 123/73 V |
| 2,706,972 | 4/1955 | Kiekhaefer | 123/73 V |
| 2,731,960 | 1/1956 | Kircher et al. | 123/73 V |
| 2,804,861 | 9/1957 | Heidner | 123/59 B |
| 2,838,035 | 6/1958 | Rice | 123/73 V |
| 3,815,559 | 6/1974 | Anderson | 123/73 V |

*Primary Examiner*—Wendell E. Burns

*Attorney, Agent, or Firm*—O. T. Sessions

[57] ABSTRACT

The invention provides an induction system for supplying air-fuel mixture to a two-cycle, crankcase compression engine (10). A single carburetor barrel (18) supplies mixture to each crankcase compartment (15) through a reed valve assembly having a plurality of reed valve members (29) arranged in a circular pattern. An axially symmetric passage leads from the carburetors (17) to the reed valves and has a generally conical flow modifying body (40) projecting forwardly from the reed valves.

13 Claims, 6 Drawing Figures

INDUCTION SYSTEM FOR A TWO-CYCLE ENGINE

DESCRIPTION

1. Technical Field

This invention relates to induction systems for supplying air-fuel mixture to two-cycle, crankcase compression internal combustion engines, and particularly to such systems having a single carburetor barrel for each cylinder.

2. Background Art

Current large, two-cycle crankcase compression engines generally use reed valves mounted on the crankcase to serve as inlet valves to the crankcase. To assure adequate breathing and provide a high specific output in such engines it is generally desirable to provide a single carburetor barrel to supply air-fuel mixture to each crankcase and corresponding engine cylinder. In such arrangements, however, the inlet reed valves are only open approximately forty percent of the time. As a result, flow in the induction passage which extends through the carburetor to the inlet reed valves is highly unsteady and characterized by the presence of pressure waves resulting from the opening and closing of the reed valves. Thus an improperly designed induction passage can result in inefficient flow patterns, and in some instances, create spitback of air-fuel mixture out the inlet of the carburetor.

In modern high output engines, the reed valve assembly typically uses a V-type reed block such as those shown in U.S. Pat. No. 3,269,374 and No. 4,244,332. Though this arrangement is generally effective to provide a high flow rate to the engine without producing spitback through the carburetor, a relatively long induction passage is required.

A variety of other arrangements have been used, including a flat reed plate having several reeds mounted on the engine crankcase, with the reed plate perpendicular to the induction passage leading from the carburetor. Some smaller engines using one carburetor barrel to charge two cylinders have used a reed plate having a plurality of reed valves arranged in a circular pattern on each cylinder's crankcase. This arrangement has proven effective, apparently because of the substantially continuous flow through the carburetor which results from feeding two cylinders from the same carburetor barrel. Others have found it necessary to affix a resonant chamber to the reed cavity to smooth pulsations which can reduce flow of mixture into the engine.

DISCLOSURE OF INVENTION

The present invention provies a two-cycle, crankcase compression engine having a crankshaft, a crankcase surrounding the crankshaft, and an inducation passage for supplying air-fuel mixture to the crankcase. A reed valve means mounted in the induction passage includes a valve seat member having a plurality of valve ports arranged in a circular pattern equidistant from the axis of the induction passage and a plurality of reed valve members, each normally closing one of the valve ports and opening in response to low pressure within the crankcase to admit air-fuel mixture to the crankcase. A flow modifying body mounted in the induction passage immediately upstream from the reed valve means has proven highly effective to provide efficient flow to the crankcase while preventing spitback through the carburetor over the engine's speed range. With the reed valve means mounted on the engine crankcase the induction system can have a shorter length than comparable systems using a V-type reed block.

The invention also allows the induction passage and flow modifying body to be axially symmetric, thereby providing equal flow through each of the reed valve ports and equal stress on each of the reed valve members.

In the preferred embodiment the induction passage has an increasing diameter as it approaches the reed plate, as does the flow modifying body. The flow modifying body can be readily cast integrally with the valve seat member. The invention thus provides a compact, highly effective, induction system which may be easily manufactured.

BEST MODE FOR CARRYING OUT THE INVENTION

Figure 1:
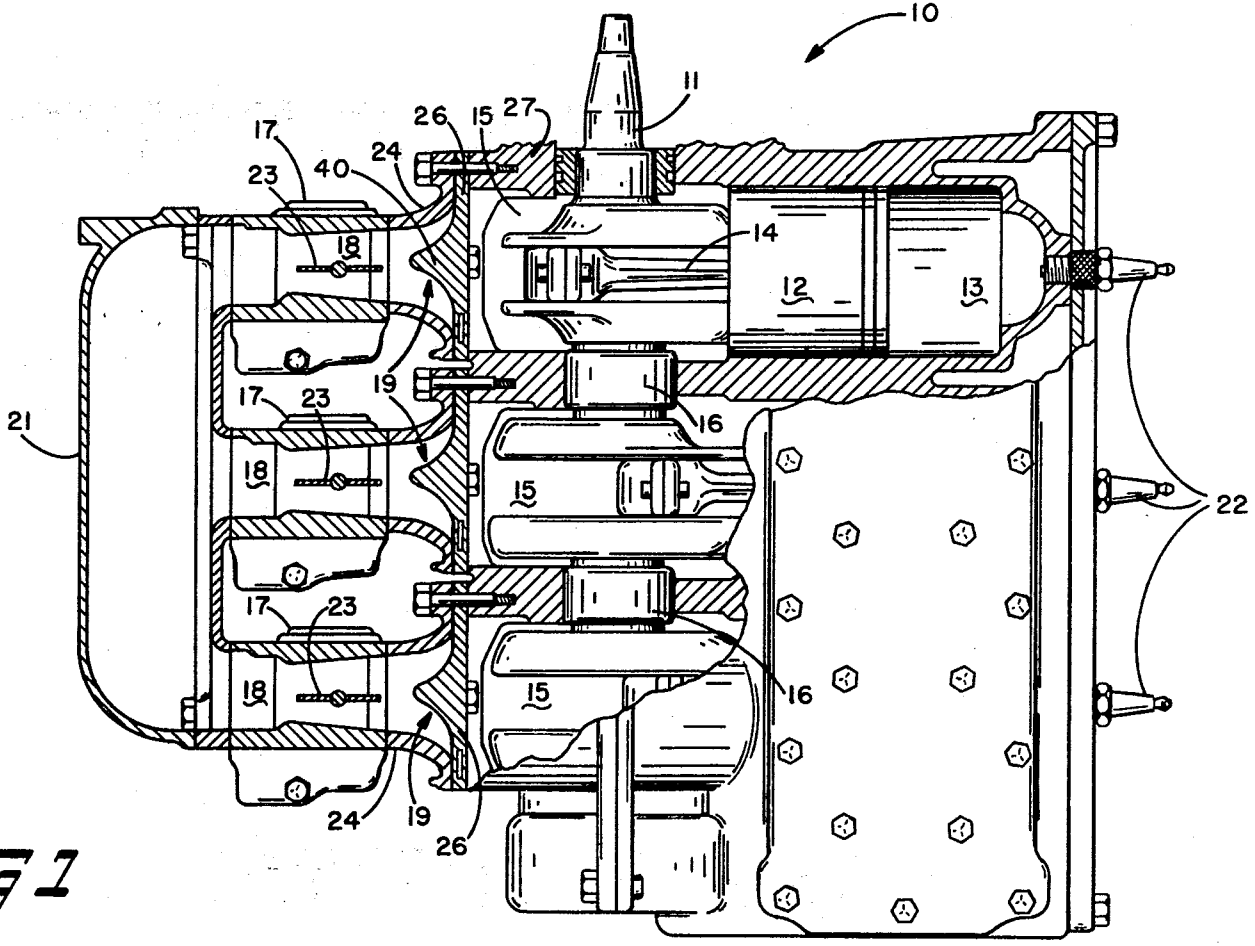
FIG. 1 is a partial sectional view in elevation of an engine incorporating the induction system of the invention.

Referring to the drawings, FIG. 1 shows an elevation view in partial section of a three cylinder engine 10 incorporating the induction system of the invention, and particularly intended for use in an outboard motor. As is conventional in outboard motors, the crankshaft 11 is mounted for rotation about a generally vertical axis. A piston 12 is mounted for reciprocation within each engine cylinder 13 and is connected by a connecting rod 14 to drive the crankshaft 11. A separate crankcase compartment 15 is provided for each of the three cylinders 13 with the compartments 15 separated from each other by the crankshaft bearings 16.

The crankcase compartments 15 are subjected to compression and expansion as the pistons 12 reciprocate to provide a pumping action. Air-fuel mixture is supplied to each of the crankcase compartments 15 by three single barrel carburetors 17 mounted on the crankcase in accordance with the present invention, with each carburetor barrel 18 supplying one of the crankcase compartments 15 through a reed valve means 19 mounted in the induction passage. A conventional air inlet silencer 21 is provided for the carburetor inlets. Air-fuel mixture is drawn into the crankcase compartments 15 on the piston upstroke and compressed and forced into the cylinders 13 through a loop charging system, not illustrated, on the piston downstroke. The air-fuel mixture is then compressed in the cylinder 13, ignited by the spark plugs 22, expanded in the piston's power stroke, and exhausted through exhaust ports, not illustrated, to complete a conventional two-stroke cycle.

The engine induction system includes the three carburetors 17, each having a single barrel 18 with a venturi passage and circular cross-section. The carburetors 17 serve to meter a mixture of fuel and air to provide the desired air-fuel ratio in a conventional manner. The flow of air-fuel mixture to the engine 10 is controlled by conventional throttle valves 23 mounted in the carburetor barrels downstream from the venturis.

The carburetors 17 are each supported on the engine crankcase by an induction casting member 24. The induction member 24 includes an axially symmetric passage aligned with the axis of the carburetor barrel 18 which flares from the diameter of the carburetor barrel to a significantly larger diameter at its exit end matching the diameter of the crankcase inlet opening 25.

A valve seat member 26, mounted between the induction member 24 and the crankcase 27, assures one way flow into the crankcase from the induction passage. The valve seat member 26 includes a ring of nine circular valve ports 28 with their outer edges aligned with the edge of the circular inlet to the crankcase 27. To prevent the accumulation of liquids in the lowest portion of the induction passage, one of the valve ports 28 is positioned at the lowest point of the crankcase inlet 25.

Figure 2:
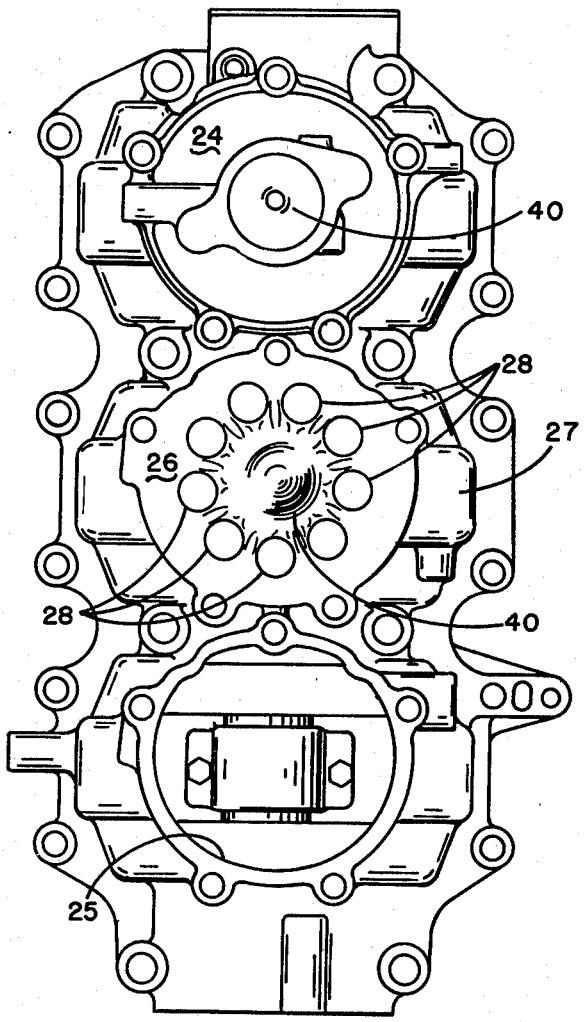
FIG. 2 is a view in elevation showing the crankcase end of the engine in FIG. 1 with parts of the induction manifold removed.
Figure 3:
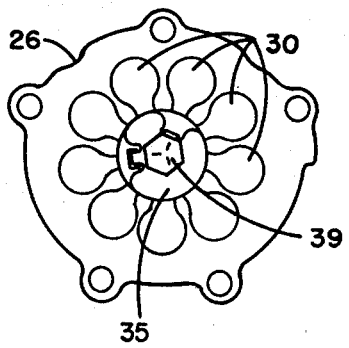
FIG. 3 is an interior view of one of the induction castings.
Figure 4:
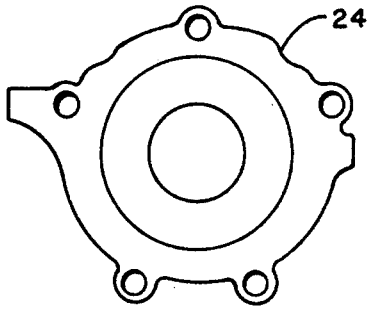
FIG. 4 is an interior view of one of the reed valve blocks.
Figure 5:
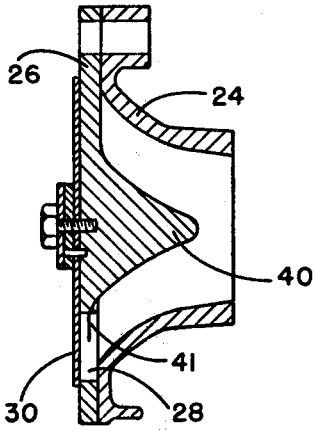
FIG. 5 is an enlarged sectional view showing the reed valve assembly and induction casting.
Figure 6:
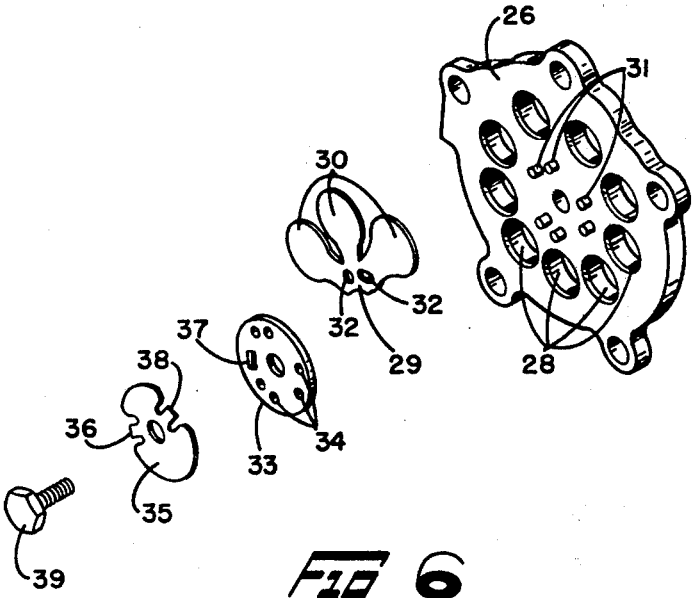
FIG. 6 is an exploded view showing the reed valve assembly.

Three reed valve members 29, each including three valve petals 30 are mounted on the inside of the valve seat members 26 to normally close the valve ports 28 and open in response to low pressure within the crankcase compartment 15. As most clearly shown in FIG. 6, alignment pins 31, pressed into the valve seat member 26, mate with holes 32 in the valve members 29 to hold the valve members 29 in alignment with the valve ports 28. A circulr clamping member 33, having holes corresponding to the alignment pins 34, fits over the reeds to clamp the reed valve members 29 in place. A tab washer 35 fits over the clamping member 33 and has one tab 36 bent down to engage a slot 37 in the clamping member 33 and another tab 38 bent up after assembly to lock the machine screw 39 against rotation. Because the valve petals 30 are symmetrically positioned in the induction system, they will be generally equally stressed during their operation. A flared conical flow modifying body 40 is formed on the valve seat member and projects forward into the induction passage. Together, the flow modifying body and the induction member define a flow passage having an increasing cross-sectional area which increases as the valve ports are approached. As most clearly shown in FIGS. 2 and 5, the valve ports 28 have an inlet surface 41 matching the contour of the flow modifying body to provide relatively smooth flow to the valve ports.

An engine built as described above, but without the flow modifying body formed on the valve seat members, was tested. Though the engine's performance at idle and low speeds was qualitatively better than engines using a V-type reed block, substantial spitback through the carburetor was observed in the higher speed ranges. The spitback was observed as a visible cloud of air-fuel mixture outside the carburetor inlets and created a measurable reduction in power and an increase in fuel consumption.

Surprisingly, when the flow modifying bodies were provided on the valve seat members, power was increased and fuel consumption reduced in the higher speed range, with no deterioration in performance at low speeds. Further, no signs of spitback were visible at the carburetor inlets. The present invention thus provides an induction system capable of high performance throughout the engine operating range and which is compact and easily manufactured.

I claim:

1. A two-cycle, crankcase compression engine comprising:

(A) a crankshaft;

(B) a crankcase surrounding said crankshaft;

(C) an induction passage for supplying air-fuel mixture to said crankcase, said induction passage having an axis transverse to the axis of said crankshaft;

(D) a reed valve means mounted in said induction passage, said reed valve means including a valve seat member having a plurality of valve ports arranged in a generally circular pattern equidistant from the axis of said induction passage, and a plurality of reed valve members, each normally closing one of said valve ports and opening in response to low pressure within said crankcase to admit air-fuel mixture to said crankcase;

(E) a flow modifying body mounted in said induction passage immediately upstream from said reed valve means; and (F) a carburetor mounted on said engine, said carburetor having a barrel, said barrel having an axis aligned with the axis of said induction passage.

2. The engine defined in claim 1 wherein said reed value means is mounted on said crankcase.

3. The engine defined in claim 2 wherein said induction passage is axially symmetric.

4. The engine defined in claim 3 wherein said induction passage has an increasing diameter as it approaches said reed valve means.

5. The engine defined in claim 3 or 4 wherein said flow modifying body is axially symmetric about the axis of said induction passage.

6. The engine defined in claim 5 wherein the diameter of said body increases in the downstream direction.

7. The engine defined in claim 6 wherein said body is mounted on said valve seat member.

8. The engine defined in claim 1 wherein said valve ports are generally circular.

9. The engine defined in claim 1 wherein said reed valve members are attached to said valve seat member on their radially inward ends.

10. The engine defined in claim 9 wherein said reed valve members have a portion covering said ports.

11. The engine defined in claim 10 wherein said valve members have sections of reduced area on their radially inward ends to reduce their stiffness.

12. The engine defined in claim 10 wherein said valve ports all lie in a single plane perpendicular to the axis of said induction passage.

13. The engine defined in claim 1 wherein said axis of said induction passage is perpendicular to the axis of said crankshaft.

* * * * *